US008200106B2

(12) United States Patent
Gomi

(10) Patent No.: US 8,200,106 B2
(45) Date of Patent: Jun. 12, 2012

(54) IMAGE FORMING APPARATUS WITH IMAGE FORMING CONDITION CONTROL FEATURE BASED ON DIFFERENCE IN PATCH DENSITIES

(75) Inventor: Fumiteru Gomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 12/793,123

(22) Filed: Jun. 3, 2010

(65) Prior Publication Data

US 2010/0316401 A1 Dec. 16, 2010

(30) Foreign Application Priority Data

Jun. 11, 2009 (JP) ..... 2009-140604

(51) Int. Cl.
*G03G 15/00* (2006.01)

(52) U.S. Cl. ..... 399/49

(58) Field of Classification Search ..... 399/49, 399/72, 74

See application file for complete search history.

(56) References Cited

U.S. PATENT DOCUMENTS 4,419,010 A * 12/1983 Grombone et al. ..... 355/133
4,962,407 A * 10/1990 Ueda ..... 335/208
5,298,944 A * 3/1994 Sawayama et al. ..... 399/49
7,536,120 B2 5/2009 Ishida

FOREIGN PATENT DOCUMENTS

JP 10-73975 A 3/1998
JP 10-90993 A 4/1998
JP 2006-189654 A 7/2006
JP 2007-58140 A 3/2007

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

An image forming apparatus includes a photosensitive member; a charging device for electrically charging the photosensitive member; an exposure device for exposing to light the photosensitive member electrically charged by the charging device to form an electrostatic image; a developing device for developing the electrostatic image with toner to form a first patch and a second patch; a detecting device for detecting a density of the first and second patches formed by the developing device; and a control device for controlling an image forming condition on the basis of a difference in density between the first patch formed on the photosensitive member at a portion where a surface potential of the photosensitive member is zero volts and the second patch formed at a portion electrically charged by applying a predetermined charging bias to the charging device.

4 Claims, 13 Drawing Sheets

IMAGE FORMING APPARATUS WITH IMAGE FORMING CONDITION CONTROL FEATURE BASED ON DIFFERENCE IN PATCH DENSITIES

FIELD OF THE INVENTION AND RELATED ART

The present invention relates to an image forming apparatus of an electrophotographic type, such as a printer, a copying machine or a facsimile machine.

In a conventional electrophotographic image forming apparatus, there has arisen a problem such that a charge potential of a photosensitive member is changed depending on the number of total image formation (the number of sheets subjected to continuous image formation), an environment, or the like. For example, in the case where a difference between a charge potential and a developing potential of the photosensitive member is not less than a certain value in the image forming apparatus using a two component developer containing toner and a carrier, the carrier can be deposited on the photosensitive member to damage the photosensitive member or to contaminate the inside of a main assembly of the image forming apparatus. In the case where the difference between the charge potential and the developing potential is not more than a certain value, image defect which is called background fog occurs.

One factor of deviation of the charge potential of the photosensitive member from a target value that has been considered is that an amount of dark decay of the photosensitive member is increased when the number of sheets subjected to continuous image formation is increased. It has been known that the amount of dark decay is considerably attenuated in an apparatus including a pre-exposure device. Further, in the case where a charging member for electrically charging the photosensitive member is in contact with the photosensitive member, variation in resistance value by contamination of the charging member is also considered as the factor of deviation of the photosensitive member charge potential.

Japanese Laid-Open Patent Application (JP-A) 2006-189654 discloses an apparatus in which a potential of the charged photosensitive member is measured by a sensor and a charging bias is adjusted on the basis of a result of the measurement by the sensor. As a result, it was possible to keep the charge potential of the photosensitive member at a desired value, and an occurrence of the image defect such as the background fog was suppressed.

In recent years, a compact image forming apparatus has been required in the market. In order to make the image forming apparatus compact, respective constituent elements of the apparatus are required to be reduced in size and to be disposed at a high density. For that reason, it has been difficult to ensure a space for permitting the measurement of the potential of the photosensitive member surface by a potential sensor. As an example, when a diameter of a photosensitive drum was about 60 mm, it was possible to provide, around the photosensitive drum (photosensitive member), the potential sensor in addition to a charging device, a developing device, a transfer device and a cleaning blade. However, in the image forming apparatus using the photosensitive drum having a diameter of about 30 mm, it was impossible to ensure the space in which the potential sensor was provided.

SUMMARY OF THE INVENTION

A principal object of the present invention is to suppress an occurrence of image defect such as a background fog without using a potential sensor.

According to an aspect of the present invention, there is provided an image forming apparatus comprising:

a photosensitive member;

charging means for electrically charging the photosensitive member;

exposure means for exposing to light the photosensitive member electrically charged by the charging means to form an electrostatic image;

developing means for developing the electrostatic image with toner to form a first patch and a second patch;

detecting means for detecting a density of the first and second patches formed by the developing means; and control means for controlling an image forming condition on the basis of a difference in density between the first patch formed on the photosensitive member at a portion where a surface potential of the photosensitive member is zero volts and the second patch formed at a portion electrically charged by applying a predetermined charging bias to the charging means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
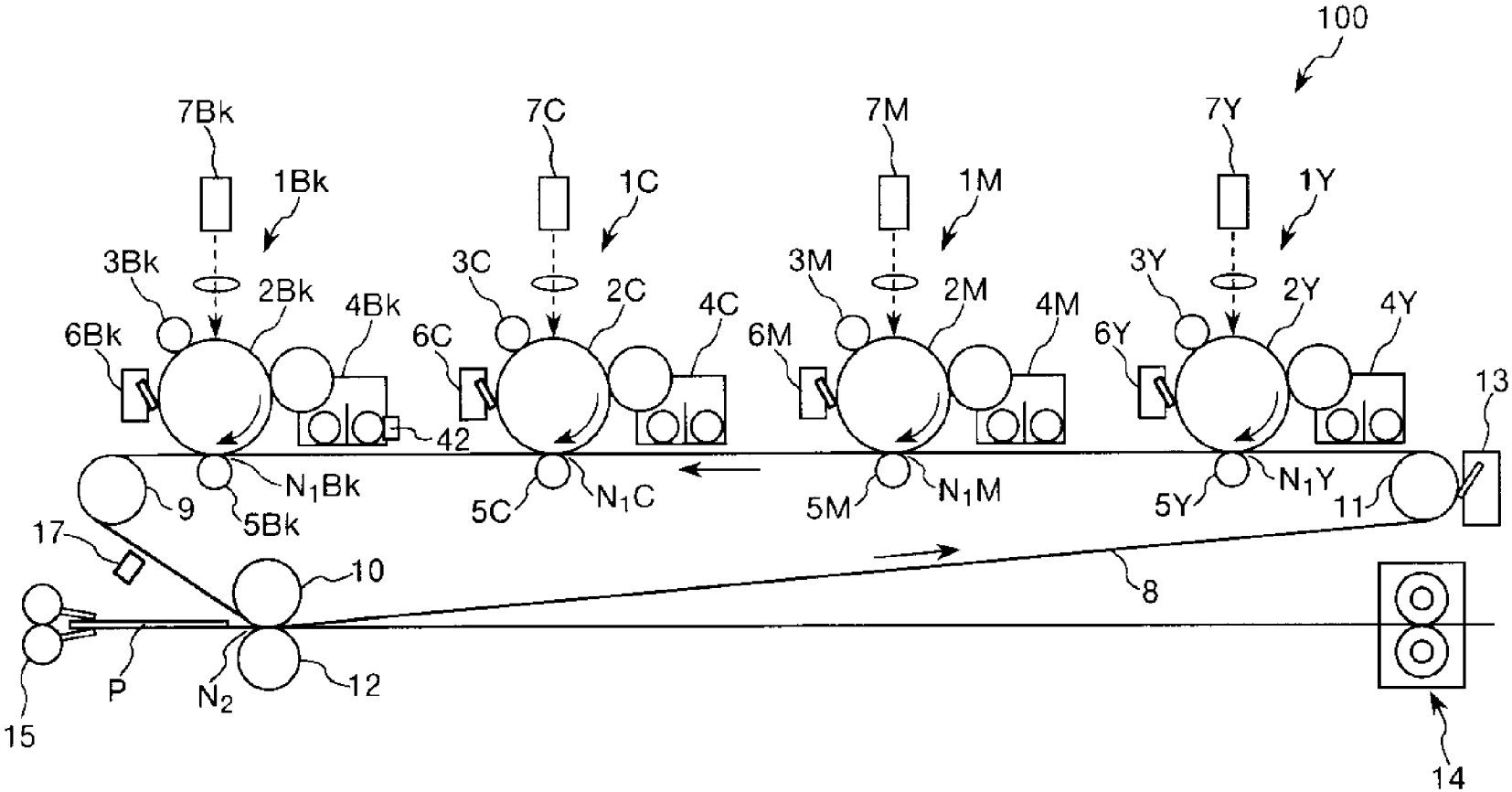
FIG. 1 is a schematic sectional illustration of an image forming apparatus.

Hereafter, the image forming apparatuses in accordance with the present invention will be described with reference to the appended drawings.

Embodiment 1

First, a general structure and operation of the image forming apparatus will be briefly described. Then, a relationship between a developing bias waveform and a developing property will be described. Finally, control for adjusting an image forming condition in view long term use (image formation) and environment will be described along a flow chart.

[General Structure and Operation of Image Forming Apparatus]

First, referring to FIG. 1, the general structure and operation of the image forming apparatus 100 in this embodiment will be described. The image forming apparatus 100 in this embodiment is an electrophotographic full-color printer including four image forming portions (stations) 1Y, 1M, 1C, and 1Bk (first, second, third, and fourth image forming portions) provided correspondingly to four colors of yellow, magenta, cyan, and black. The image forming apparatus 100 can form a full-color image on a recording material (a recording sheet, a plastic film, fabric, etc.) P in response to image signals sent from an external device connected to a main assembly of the image forming apparatus 100. The external device may include an original reading device, a host device such as a personal computer, a digital camera, and the like. The first to fourth image forming portions 1 (1Y, 1M, 1C, 1Bk) include cylindrical photosensitive members 2 (2Y, 2M, 2C, 2Bk) as an image bearing member rolled in a direction indicated by an arrow (hereinafter referred to as a photosensitive drum). In the first to fourth image forming portions 1 (1Y, 1M, 1C, 1Bk), toner images formed on the photosensitive drums 2 (2Y, 2M, 2C, 2Bk) are transferred onto an intermediary transfer belt 8 as an intermediary transfer member. Then, the toner images on the intermediary transfer belt 8 are transferred onto the recording material P to form recording images. Incidentally, in the following description, constituent elements common to the four image forming portions 1 (1Y, 1M, 1C, 1Bk) are represented by identical reference numerals by adding suffixes Y, M, C and Bk. In the case where there is no need to particularly discriminate and describe the constituent elements, they are collectively described by omitting the suffixes Y, M, C and Bk added for representing the constituent elements with respect to the colors of yellow, magenta, cyan and black, respectively.

Further, around the photosensitive drum 2, a charging roller 3 as a charging means, a developing device 4 as a developing means, a primary transfer roller 5 as a primary transferring means, and a cleaning apparatus 6 as a cleaning means are disposed. Above the photosensitive drum 2 in FIG. 1, a laser scanner 7 (expose device or an exposure means) as a latent image forming means for forming an electrostatic latent image is disposed. Further, the intermediary transfer belt 8 is disposed oppositely to the photosensitive drum 2 of each of the image forming portions 1. The intermediary transfer belt 8 is stretched around a driving roller 9, a secondary transfer opposite roller 10, and a follower roller 11, and is circularly moved in the direction indicated by an arrow by a driving force transmitted to the driving roller 9. The intermediary transfer belt 8 contacts the photosensitive drum 2, forming a primary transfer portion (primary transfer nip) $N_1$ ($N_1$Y, $N_1$M, $N_1$C, $N_1$Bk) at a position in which the primary transfer roller 5 opposes the photosensitive drum 2. Further, a secondary transfer roller 12 as a secondary transferring means is disposed oppositely to the secondary transfer opposite roller 10, with the intermediary transfer belt 8 disposed between the two rollers 12 and 10. The secondary transfer roller 12 contacts the intermediary transfer belt 8, forming a secondary transfer portion (secondary transfer nip) $N_2$ at a portion in which it opposes the secondary transfer opposite roller 10.

In this embodiment, the image forming apparatus 100 is operable in a full-color image forming mode in which it can form a full-color image with the use of all of the first to fourth image forming portions 1Y, 1M, 1C, and 1Bk. Further, the image forming apparatus 100 is operable in a monochromatic image forming mode in which a black (monochromatic) image is formed with the use of only the fourth image forming station 1Bk.

First, the image forming operation in the full-color image forming mode will be described. When the image forming operation is started, the surfaces of the rotating photosensitive drums 2 (2Y, 2M, 2C, 2Bk) at the image forming portions 1 (1Y, 1M, 1C, 1Bk) are uniformly charged by the charging rollers 3 (3Y, 3M, 3C, 3Bk). In this case, charging biases are applied to the charging rollers 3 (3Y, 3M, 3C, 3Bk) from a charging bias power source.

Next, laser light are emitted, in accordance with image signals for separated colors corresponding to the respective image forming stations, from the exposure device 7 (7Y, 7M, 7C, 7Bk). As a result, each of the photosensitive drums 2 (2Y, 2M, 2C, 2Bk) is exposed to light depending on the image information for corresponding separated color, so that an electrostatic image (latent image) depending on the image signal is formed on the photosensitive drum.

The electrostatic image formed on each photosensitive drum 2 (2Y, 2M, 2C, 2Bk) is developed as a toner image with the toner stored in the associated developing device 4 (4Y, 4M, 4C, 4Bk). In this embodiment, a reverse developing method is employed as the developing method, so that the toner from the developing device 4 is deposited at the exposed portion (light potential portion) on the photosensitive drum 2.

The toner images formed on the respective photosensitive drums 2 (2Y, 2M, 2C, 2Bk) are sequentially transferred (primary-transferred) superposedly onto the intermediary transfer belt 8 in the primary transfer portions $N_1$. In this case, primary transfer biases, the polarities of which are opposite to the normal charge polarity of the toner, are applied to the primary transfer rollers 5 (5Y, 5M, 5C, 5Bk) from a primary transfer bias power source. As a result, a multicolor image is formed on the intermediary transfer belt 8, by the superposed four toner images. Incidentally, the toners (primary transfer residual toners) remaining on the surfaces of the photosensitive drums 2 (2Y, 2M, 2C, 2Bk) are collected by the cleaning devices 6 (6Y, 6M, 6C, 6Bk).

Separately, the recording material P accommodated in a recording material accommodating cassette (not shown) is conveyed to the secondary transfer portion $N_2$ by a supplying roller 15 or the like in synchronization with the movement of the toner images on the intermediary transfer belt 8. The superposed toner images on the intermediary transfer belt 8 are then collectively transferred (secondary-transferred) onto the recording material P in the secondary transfer portion $N_2$. In this case, the secondary transfer bias, the polarity of which is opposite to the normal charge polarity of the toner, is applied to the secondary transfer roller 12 from a secondary transfer bias power source.

Then, the recording material P is conveyed to a fixing device 14 as a fixing means by a conveying member or the like. By the fixing device 14, the toner on the recording medium P is subjected to heat and pressure to be melted and mixed, so that, the toner on the recording medium P is fixed on the recording material P to form a full-color image on the recording material P. Thereafter, the recording material P is discharged outside the image forming apparatus. Incidentally, the toner (secondary transfer residual toner) which is not transferred onto the recording material P in the secondary transfer portion $N_2$ and remains on the intermediary transfer belt 8 is collected by an intermediary transfer belt cleaner 13.

Next, the image forming operation in the monochromatic image forming mode will be described. In the monochromatic image forming mode, the toner image is formed, only in the fourth image forming portion 1Bk, on the photosensitive drum 2Bk. Then, after this toner image is primary-transferred onto the intermediary transfer belt 8, the toner image is secondary-transferred onto the recording material P. The image forming operation of the toner image in the fourth image forming portion 1Bk, the primary transfer operation, and the secondary transfer operation are the same as those in the abovementioned full-color image forming mode.

[Developing Device]

A detailed constitution of the developing device will be described below and then the toner and the carrier will be described. Incidentally, toner supply amount and developing bias adjustment on the basis of an optical density of a toner patch will be described later.

(Developing Device Constitution)

Figure 2:
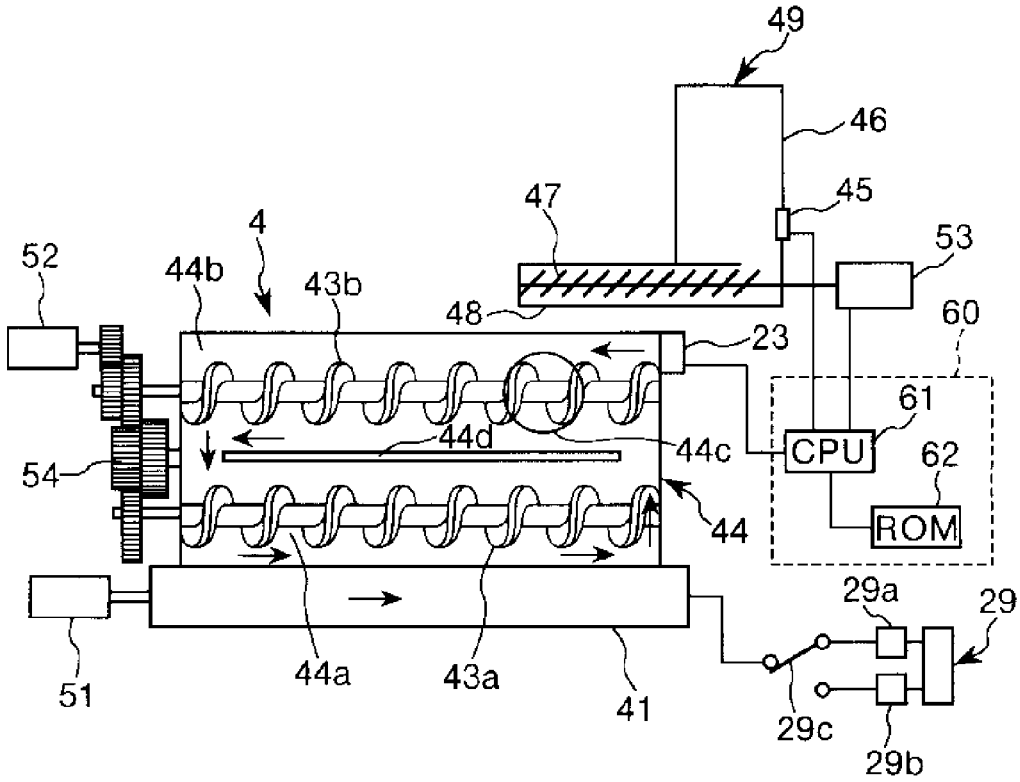
FIG. 2 is a schematic view for illustrating a developing device and a toner supplying device.

With reference to FIG. 2, the developing devices 4 (4Y, 4M, 4C, 4Bk) and toner supplying devices 49 for supplying the toner to the developing devices 4 (4Y, 4M, 4C, 4Bk) will be described. In this embodiment, the respective developing devices 4Y, 4M, 4C and 4Bk have the same constitution. Therefore, they will be collectively described as the developing device 4. Also in this embodiment, all the toner supplying devices 49 are identical in constitution and the constitution is common to all the developing devices 4 (4Y, 4M, 4C, 4Bk). In FIG. 2, the developing device 4 is illustrated in the form of a plan view as seen from above in FIG. 1, and the toner supplying device 49 is illustrated in the form of a sectional front view along an axial direction of the photosensitive drum 2 (i.e., the direction perpendicular to a surface movement direction of the photosensitive drum 2).

The developing device 4 includes a developing container 44 (a main body of the developing device) a in which two-component developer (developer) primarily made up of non-magnetic toner particles (toner) and magnetic carrier particles (carrier). In the developing container 44, two screws as stirring-and-conveying means, consisting of a first stirring-and-conveying screw 43*a* and a second stirring-and-conveying screw 43*b* are disposed. The developing container 44 has an opening which faces the photosensitive drum 2 and partially exposes a developing sleeve 41 as a developer carrying member, which is rotatably disposed in the developing container 44. Inside the developing sleeve 41, a magnetic roller (unshown) as a magnetic field generating means is fixedly disposed. The magnetic roller has multiple magnetic poles with respect to its circumferential direction, and its magnetic force attracts the developer in the developing container 44, not only causing the developer to be carried on the developing sleeve 41, but also, causing the developer to form an erected chain of the developer (magnetic brush) at a developing position in which it opposes the photosensitive drum 2.

The developing sleeve 41 and the first and second stirring-and-conveying screws 43*a* and 43*b* are disposed in parallel. Further, the development sleeve 41 and the first and second stirring-and-conveying screws 43*a* and 43*b* are disposed in parallel to the axial direction of the photosensitive drum 2. The inside of the developing container 44 is divided into a first chamber 44*a* (developing chamber) and a second chamber 44*b* (stirring chamber) by a partition wall 44*d*. The developing chamber 44*a* and the stirring chamber 44*b* are connected to each other at both longitudinal end portions of the developing container 44 (left and right ends in FIG. 2).

The first stirring-and-conveying screw 43*a* is disposed in the developing chamber 44*a*, and the second stirring-and-conveying screw 43*b* is disposed in the stirring chamber 44*b*. These first and second stirring-and-conveying screws 43*a* and 43*b* are rotationally driven in the same direction by rotation of a motor 52 through a gear train 54. By this rotation, the developer in the stirring chamber 44*b* is moved leftward in FIG. 2 by the second stirring-and-conveying screw 43*b* while being stirred by the screw 43*b*, and then, moves into the developing chamber 44*a* through the connecting portion. Further, the developer in the developing chamber 44*a* is moved rightward in FIG. 2 by the first stirring-and-conveying screw 43*a* while being stirred by the screw 43*a*, and moves into the stirring chamber 44*b* through the connecting portion. In other words, the developer is circularly moved in the developing container 44 by the first and second stirring-and-conveying screws 43*a* and 43*b* while being stirred by the two screws 43*a* and 43*b*.

By the stirring and conveyance as described above, the toner in the developer is provided with electric charges. In this embodiment, the toner is supplied into the developing container 44 through a toner supply opening 44*c* provided at an upper portion of the inside of the stirring chamber 44*b* on a developer conveyance direction upstream end portion side. On the right-hand end side of the stirring chamber 44*b* in the figure, a window through which the state of the inside of the stirring chamber 44*b* can be observed with eyes is provided.

The developing sleeve 41 is rotationally driven by a motor 51 in the direction (counterclockwise direction) indicated by the arrow in FIG. 1. The developing sleeve 41 conveys the developer coated on its surface in a layer by a regulating blade (unshown) to the developing position in which the layer of developer opposes the photosensitive drum 2, by its rotation. At the developing position, the developer on the developing sleeve 41 is caused to form the erected thereof by the magnetic force of the magnetic roller, thus forming the magnetic brush, which is in contact with or in proximity to the surface of the photosensitive drum 2. Thus, the toner is supplied to the electrostatic image on the photosensitive drum 2 from the (two-component) developer which has been conveyed to the developing position. As a result, the toner is selectively deposited on the image portion for the electrostatic image, so that the electrostatic image is developed as the toner image.

Further, when the electrostatic image on the photosensitive drum 2 reaches the developing position, a developing bias in the form of superposition of AC and DC voltages is applied to the developing sleeve 41 from a development bias power source (unshown). At this time, the developing sleeve 41 is rotationally driven in the direction indicated by the arrow in FIG. 1 by the motor 51, and the toner in the developer is transferred onto the photosensitive drum 2 by the above-mentioned developing bias correspondingly to the electrostatic image on the surface of the photosensitive drum 2.

(Toner and Carrier)

The toner and the carrier used in this embodiment will be described below.

In this embodiment, the toner contains colored resinous particles containing a bonder resin, a coloring agent, and additives which are added as necessary and contain colored particles to which an external additive such as fine powder of choroidal silica has been added. The toner is formed of negatively chargeable polyester resin produced by polymerization and may preferably have a volume average particle size of not less than 5 μm and not more than 8 μm. In this embodiment, the volume average particle size of the toner is 6.2 μm.

As the carrier, magnetic particles of surface-oxidized or unoxidized metals, such as iron, nickel, cobalt, manganese, chrome, and rare-earth metals; alloys of these metals; ferrite, etc., are preferably usable. A method for manufacturing these magnetic particles is not particularly limited. The weight average particle size of the carrier is 20-50 μm, preferably 30-40 μm, and the resistivity of the carrier is not less than $10^7$ ohm·cm, preferably not less than $10^8$ ohm·cm. In this embodiment, the carrier having the resistivity of $10^8$ ohm·cm was used. In this embodiment, as the magnetic carrier which is low in specific gravity, a resinous magnetic carrier, which is manufactured by mixing a phenolic binder resin, a magnetic metal oxide, and a nonmagnetic metal oxide in a predetermined ratio and by subjecting the mixture to the polymerization. The carrier used in this embodiment is 35 μm in volume average particle size, 3.6-3.7 g/cm$^3$ in true density, and 53 A·m$^2$/kg in the amount of magnetization.

(Toner Supplying Mechanism and Control Portion)

By the above-described developing operation, the toner in the two-component developer is consumed, so that a toner content of the developer (a weight ratio of the toner to the developer) in the developing container 44 is gradually decreased. Therefore, the toner is supplied to the developing container 44 by the toner supplying device 49 as a supplying means, so that the control portion controls the toner content so as to be kept at a constant level. The toner supplying device 49 includes a toner container (toner supplying container or toner storage portion) 46 for accommodating the toner to be supplied to the developing device 4. At the lower left end portion of the toner container 46 in FIG. 2, a toner discharge opening 48 is provided. The toner discharge opening 48 is connected to the toner supply opening 44*c* of the developing device 4. Further, in the toner container 46, a toner supplying screw 47 as a toner supplying member for conveying the toner toward the toner discharge opening 48 is provided. The toner supplying screw 48 is rotationally driven by a motor 53.

The rotation of the motor 53 is controlled by a CPU (central processing unit) 61 as a control means of an engine control portion 60 provided in the image forming apparatus main assembly. A relationship between a rotation time of the motor 53 in a state in which the toner in a predetermined amount is accommodated in the toner container 46 and an amount of the toner to be supplied into the developing device 44 through the toner discharge opening (the toner supply opening) by the toner supplying screw 47 has been obtained through an experiment or the like. The result thereof has been, e.g., stored as table data in an ROM (read only memory) 62 connected to the CPU 61 (or in the CPU 61) as shown in FIG. 2. That is, the CPU 61 controls (adjusts) the rotation time of the motor 53, so that the amount of the toner is supplied to the developing container 44. Incidentally, in this embodiment, as shown in FIG. 2, on the developing device 4, a storage device 23 is provided. As the storage device 23, in this embodiment, an EPROM (erasable programmable ROM) capable of performing reading and writing was used. The storage device 23 is electrically connected with the CPU 61 by setting the developing device 4 in the image forming apparatus 100, thus being capable of reading image formation processing information on the developing device 4 from the image forming apparatus main assembly and writing the image formation processing information into the image forming apparatus main assembly.

[Developing Bias and Control Timing During Patch Formation]

A control method where a patch image is formed by using the toner and respective portions of the image forming apparatus are controlled on the basis of the density of the patch image will be described below. First, a waveform of the developing bias to be applied during normal image formation (waveform A) and a waveform of the developing bias to be applied during patch image formation (waveform B) will be described with reference to FIGS. 3(*a*) and 3(*b*). Next, a relationship between a developing contrast and the image density with respect to the respective developing bias waveforms will be described with reference to FIGS. 4(*a*) and 4(*b*). Then, timing when the patch image is formed with the toner will be described with reference to FIGS. 5(*a*) and 5(*b*) and FIGS. 6(*a*) and 6(*b*).

(Constitution for Forming Patch Image and Detecting Patch Density)

In this embodiment, after a state in which the surface of the photosensitive drum 2 is charged to a predetermined reference potential is created on the photosensitive drum 2, a reference toner image (patch image) for image density detection is formed on the photosensitive drum 2 by developing a resultant latent image on the photosensitive drum 2 under a predetermined developing condition. Instructions to form the patch image are provided by the CPU 61 shown in FIG. 2. Then, this patch image is transferred onto the intermediary transfer belt 8 and then the density of the patch image is detected by an image density detecting means (image density sensor) 17. The image density detecting means 17 inputs density signals, corresponding to the image density (toner deposition amount) of the patch image, into the CPU 61. The CPU 61 compares the density signal from the image density sensor 17 with an initial reference signal stored in advance in the CPU 61, and controls a drive time of the toner supplying device 49 on the basis of the result of the comparison. Incidentally, as the image density sensor 17, an ordinary optical sensor of a light reflection type can be employed. The operation during the patch image formation will be described in more detail. The CPU 61 as the control means reads an ambient table stored in advance in the ROM 62. In the ambient table, set values for a process condition depending on information about temperature and humidity, and for a process condition such as a developing bias or a transfer bias. The CPU 61 obtains an ambient environment (temperature and humidity) of the image forming apparatus from an environment sensor and determines an image forming condition on the basis of the ambient table.

Incidentally, when the image forming condition is adjusted from the patch (image) density described later, in order to alleviate the influence of the exposure device 7 on the image forming condition, the patch image is formed with no exposure by the exposure device 7. That is, a contrast potential for a patch latent image is formed, without substantially subjecting to laser exposure the charged photosensitive member, by a potential difference between the developing bias and a potential of the photosensitive member (in an area in which the photosensitive member is charged by the charging roller but is not subjected to the exposure by the exposure device). Then, the resultant patch latent image is developed into a patch image, thus forming the patch image. This method is referred to as an "analog patch image (forming) method".

Here, the expression "without substantially subjecting to the laser exposure" refers to not only the case where the laser exposure is not performed but also the case where a driving voltage is applied to a semiconductor laser as an image exposure means and the semiconductor laser emits faint light to the extent that the photosensitive member potential is not attenuated.

Incidentally, a "digital patch image (forming) method" refers to a method in which a patch latent image is formed by performing the image exposure in accordance with the PWM (pulse width modulation) method and then is developed into a patch image. In this embodiment, the image forming apparatus forms an image on a sheet through the image exposure in accordance with the PWM method during normal image formation.

Here, the image forming apparatus in this embodiment adjusts the image forming condition on the basis of the density of the patch image formed by the analog patch image method in which the charged photosensitive member is not substantially subjected to the laser exposure. Further, in order to adjust the density of the image to be output during the image formation, the image forming apparatus adjusts density gradation or the like of the toner image to be output during the image formation on the basis of the density of the patch image formed by the digital patch image method in which the image exposure is performed in accordance with the PWM method.

(Developing Bias Waveform and Developing Property)

Next, the development bias in this embodiment will be described. The image forming apparatus includes, as shown in FIG. 2, a high voltage power supplying device 29, as a developing bias outputting means, which is connected to the CPU 61 as the controlling means. The high voltage power supplying device 29 has two high voltage power sources (developing bias application power sources), i.e., first and second high voltage power sources 29*a* and 29*b*. The first high voltage power source 29*a* is capable of applying a developing bias A to each developing device, and the second high voltage power source 29*b* is capable of applying a developing bias B to each developing device. Further, the high voltage power supplying device 29 includes a developing bias switching means 29*c*, which enables the high voltage power supplying device 29 to selectively apply to the developing sleeve 41 the output of the first or second high voltage power sources 29*a* and 29*b*. Thus, the developing bias to be applied to the developing sleeve 41 can be selectively switched.

Figure 3:
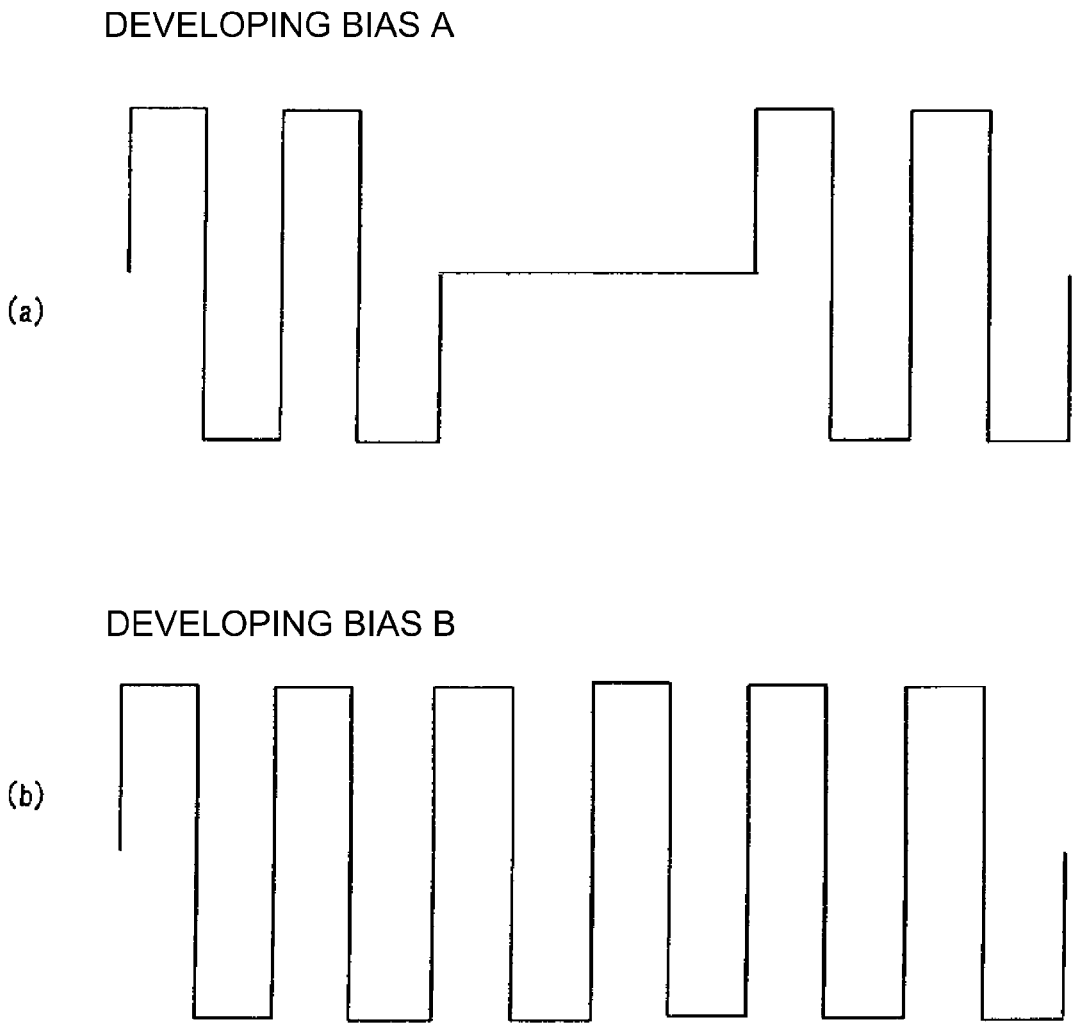
FIGS. 3(*a*) and 3(*b*) are schematic views showing time waveforms of developing biases A and B, respectively.

FIGS. 3(*a*) and 3(*b*) are diagrams showing waveforms of the developing biases A and B, respectively, which are alternating voltages to be applied to the developing sleeve 41 (in which the abscissa represents a time, and the ordinate represents the voltage applied to developing sleeve 41).

Figure 4:
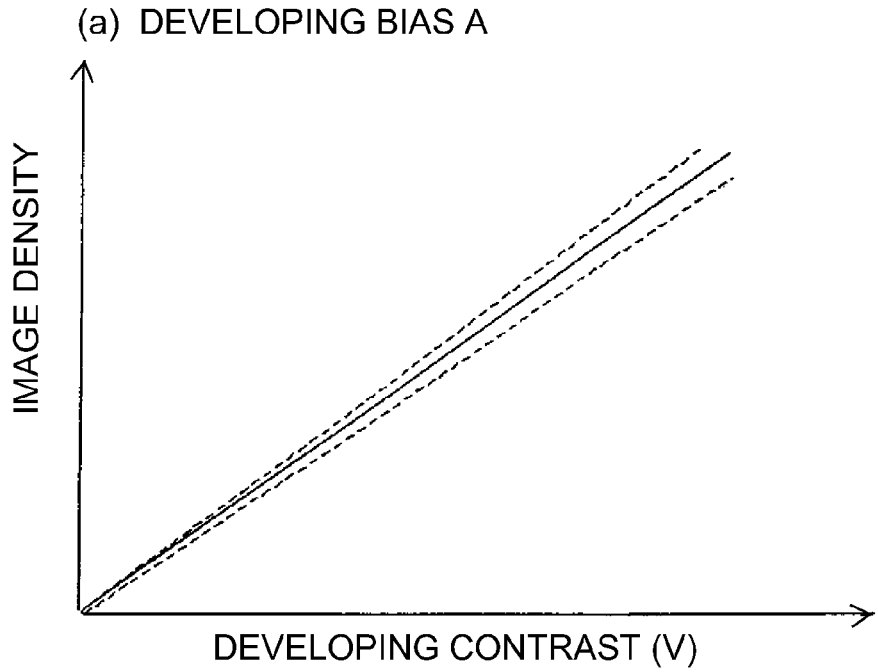
FIGS. 4(*a*) and 4(*b*) are graphs showing developing properties based on the developing biases, respectively.
Figure 4:
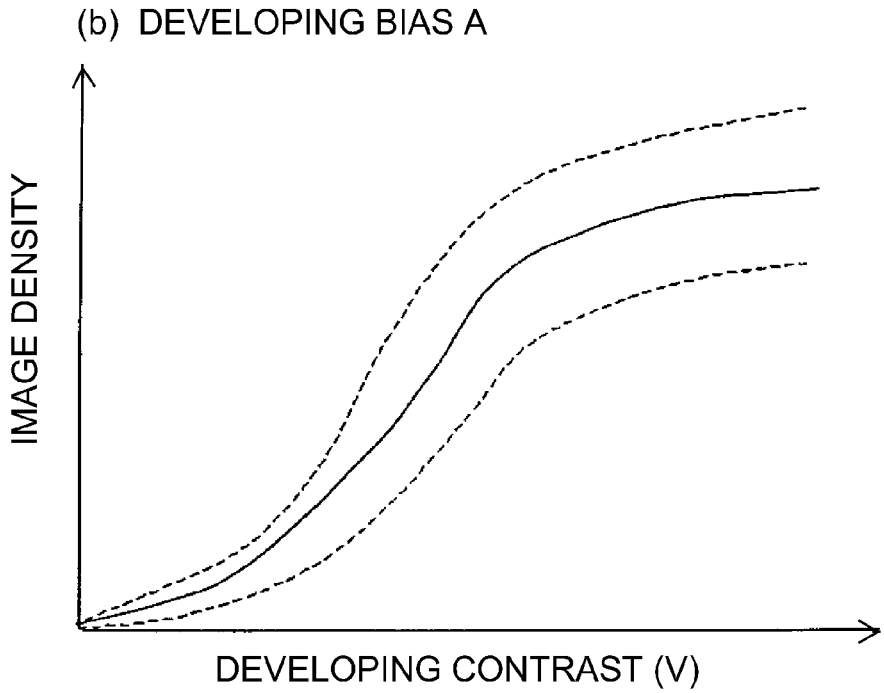

FIGS. 4(*a*) and 4(*b*) are graphs showing developing properties when the developing biases A and B are applied to the developing device. In these figures, the abscissa represents a developing contrast potential (absolute value) and the ordinate represents the patch image density detected by the sensor.

The developing bias A shown in FIG. 3(*a*) is a bias (black pulse bias) having a waveform alternately including a pulse portion which is a rectangular wave and has a predetermined number of pulses, and black portion. The pulse portion is an alternating portion at which an alternating electric field is generated by applying to developing sleeve 41, a voltage in the form of superposition of AC and DC voltages. The blank portion is a rest portion at which a certain electric field is generated by applying only the DC voltage to the developing sleeve 41. In the case of using such a developing bias A, as shown in FIG. 4(*a*), even when the toner density in the developing device 4 varies, the variation is less liable to be reflected on the toner image is formed on the photosensitive drum 2. In the figure, a solid line represents an ideal relationship (between the image density and the developing contrast), whereas the dotted lines represent the relationships (between the image density and the developing contrast) when the toner density in the developing device is changed. For that reason, the developing bias A has the developing property such that it can stabilize the image density. Further, the blank pulse bias has such a property that it is excellent in high image quality development at a highlight portion of an image, is less liable to cause the background fog, and is capable of keeping the toner particle size distribution stable even in long term use of the image forming apparatus. Further, the developing bias A is less liable to cause the reflection of the toner density variation in the image density of the toner image to be formed. Because of these properties, when the toner density of the developer is controlled based on the image density variation of the toner image at the developing bias A, there is tendency that the load exerted on the developer is increased, so that developer deterioration is liable to be accelerated.

On the other hand, the developing bias B, shown in FIG. 3(*b*), is a rectangular pulse bias and repeatedly includes the alternating portion at which the alternating electric field is generated by applying to the developing sleeve 41 the voltage in the form of superposition of the AC and DC voltages. When the developing bias B is used, as shown in FIG. 4(*b*), such a developing property that the image (toner image) to be formed (by the development) faithfully reflects and reproduces the toner density of the developer in the developing device 4 is exhibited. In the figure, the solid line represents the ideal relationship (between the image density and developing contrast), whereas the dotted lines represent the relationships (between the image density and developing contrast) when the toner density in the developing device 4 is changed. For that reason, when the developing bias B is used, the amount of fluctuation of the image density sensitively reflects the amount of fluctuation of toner density of the developer. With respect to this development bias B, the image density of the toner image to be formed is sensitively fluctuated depending on the fluctuation of the toner density of the developer. Therefore, the development bias B is suitable for controlling the toner density of the developer. As a result, the developer is stirred in the developing device in a proper toner/carrier ratio, so that it is possible to suppress the deterioration of the developer. Further, the fluctuation of the toner density attributable to the change in the thickness of the film of the photosensitive drum 2 is alleviated because the image density of the toner image to be formed is sensitively fluctuated depending on the fluctuation of the toner density.

As described above, the developing roller A is less liable to cause the amount of fluctuation of the image density (toner deposition amount) of the toner image to follow the amount of fluctuation of the toner density of the developer, i.e., stabilizes the toner image density. Further, the developing bias B causes the amount of fluctuation of the image density (toner deposition amount) of the toner image to sensitively reflect the amount of fluctuation of the toner density of the developer. Therefore, the developing bias used for developing the patch latent image is switched from the developing bias A to the developing bias B. As a result, reliability of a detection output value of the patch image to be formed in the non-image area by the image density sensor 17 can be enhanced. For this reason, the load on the developer can be alleviated and the density of the output image in the image area can be stabilized.

(Timing of Patch Image Formation)

Figure 5:
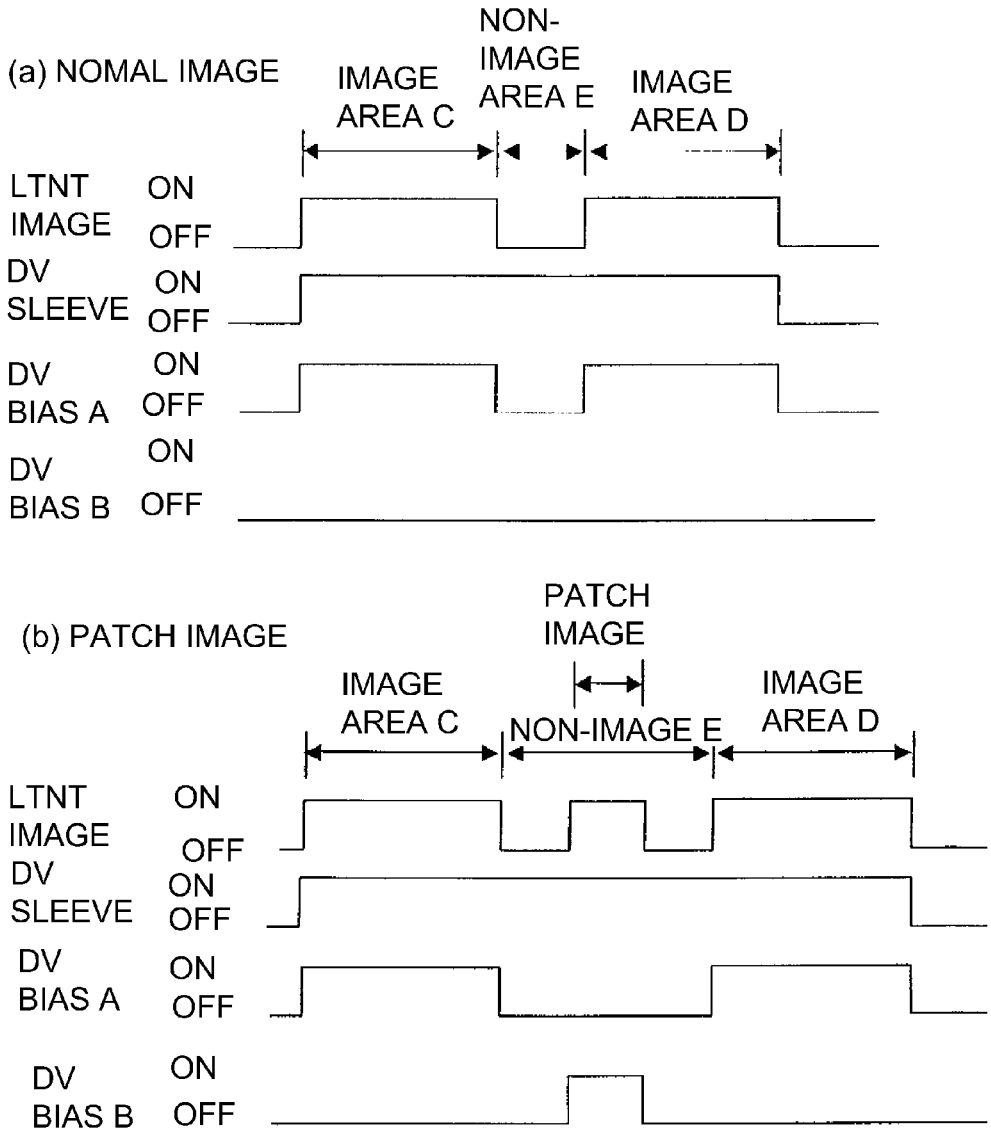
FIGS. 5(*a*) and 5(*b*) are timing charts each showing switching timing of the developing biases.

Then, the exposure and developing biases during the normal image formation and during the patch image formation will be described along timing charts. FIGS. 5(*a*) and 5(*b*) are the timing charts for illustrating states of respective image forming portions during the normal image formation and during the patch image formation.

As described above, during the normal image formation, the image is formed by applying the developing bias A to the developing device in order that the relationship between the contrast potential and the density can be closer to a linear relationship. Further, in the case where patch images to be transferred onto a sheet are formed in an image area C and an image area D, patch latent images are formed by the analog patch image method in which the exposure by the exposure device is not performed, and then the developing bias B is applied to the developing device. As a result, the patch images are formed on the intermediary transfer belt. These patch images are formed by applying the continuous rectangular wave (the developing bias B). As a result, the density of the patch image to be formed sensitively changes depending on the difference between the between the change potential of the photosensitive member and the DC component of the developing bias.

The operations of the respective image forming portions will be described below along the timing charts. FIGS. 5(*a*) and 5(*b*) are timing charts of developing bias switching during the normal image formation and during the patch image formation. In the figures, "LATENT IMAGE" represents a period in which the latent image is formed, and "DEVELOPMENT" represents a period in which the developing sleeve 41 is rotated. Further, "D.B.A" and "D.B.B" represent periods in which the developing bias A and the developing bias B and applied to the developing sleeve 41, respectively.

In this embodiment, every predetermined period (e.g., every predetermined number of sheets subjected to image output), the toner supply control by a patch detection method is carried out with predetermined timing (during the non-image formation) except during the image formation in which the image to be recorded and output on the recording material P is formed. As the predetermined timing (during the non-image formation) except during the image formation, it is possible to use during a preparatory operation before or after the image forming operation, timing corresponding to an interval between the recording material and a subsequent recording material when the image formation is continuously effected on a plurality of recording materials, and the like timing.

Figure 6:
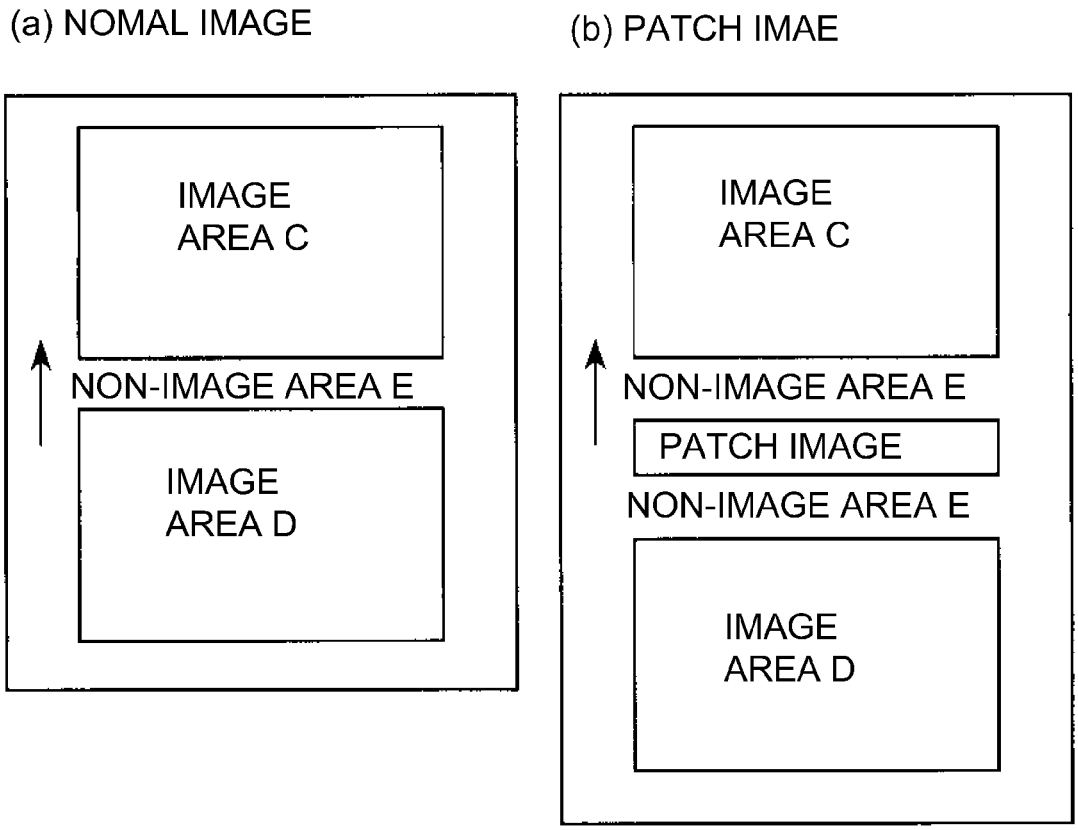
FIGS. 6(*a*) and 6(*b*) are schematic views each showing an image area and a non-image area on a surface of a photosensitive drum.

FIGS. 6(*a*) and 6(*b*) show the image areas C and D and a non-image area E on the photosensitive drum 2 in the case where the images are continuously formed on the plurality of recording materials P during the normal image formation and during the patch image formation, respectively. In each of the figures, an arrow represents a surface movement direction of the photosensitive drum 2.

An analog patch image forming process of the operation during the continuous image formation will be described with reference to FIGS. 6(*a*) and 6(*b*). An electrostatic latent image for a normal image to be formed in the image areas C on the photosensitive drum 2 is formed in the form of a digital latent image. When the digital latent image reaches the developing position in which it opposes the developing device, the developing bias A shown in FIG. 3(*a*) is applied to the developing sleeve 41 to develop the latent image. Then, during a period before start of formation of the electrostatic latent image for a subsequent normal image, the non-image area E (FIG. 6(*b*)) made wider than that (FIG. 6(*a*)) formed during the normal image formation is formed. In the non-image area E, the patch image is formed and then various adjustments are performed on the basis of the patch density.

That is, in the non-image area E, the photosensitive drum 2 is changed only by Vd (dark portion potential) without being subjected to the laser exposure, so that the analog latent image providing the potential difference between Vd and a developing bias potential Vdc is formed. When the patch latent image reaches the developing position, the developing bias to be applied to the developing sleeve 41 is switched from the developing bias A shown in FIG. 3(*a*) to the developing bias B shown in FIG. 3(*a*). The latent image is developed by the developing bias B switched from the developing bias Am so that the analog patch image is formed. Then, when the subsequent image area D reaches the developing position, the developing bias is switched from the developing bias B to the developing bias A, so that the latent image for an output image is developed in the image area D. Incidentally, a target signal value of the image density sensor may be set at and changed to an optimum target value depending on an operation status and operation environment of the developing device.

(Toner Supply Control)

A control procedure for controlling the toner supply amount on the basis of the density of the patch image described above will be briefly explained below. In the case of controlling the toner supply amount, as described above, the patch image density at the time of initial mounting of the image forming apparatus 100 is detected by the image density sensor 17, and its detection output value is input into the CPU 61 as a patch target signal value. The CPU 61 controls the amount of the toner to be supplied from the toner container 46 into the developing container 44 of the developing device 4 by using the input patch target signal value. That is, the CPU 61 controls the amount of the toner to be supplied to the developing container 44 so that the patch target signal value and the patch image density for toner supply detected during the toner supply control carried out later, i.e., the output value of the image density sensor 17 are equal to each other.

In the case of employing the "digital patch image method" in which the patch image is formed by performing the laser exposure, due to the deterioration by the use of the photosensitive drum 2, the potential fluctuation depending on the environment, and the like, the property of the photosensitive drum 2, particularly a photosensitivity property of the photosensitive drum 2 can be changed. For this reason, a difference between a potential obtained by exposing the light the photosensitive drum 2 by a laser output of the exposure device 7 and a potential, at the time of the initial mounting of the image forming apparatus, to be essentially obtained has arisen, so that the density of the image formed on the photosensitive drum 2 is deviated from a desired value due to this potential difference. When the toner supply control is carried out at the image density value including the error, the toner density in the developing device 4 is out of a desired range to result in occurrences of the image density fluctuation, toner fog, and the like, so that there is a possibility of the occurrence of the image defect.

Particularly, with reduction in cost and size, in the case where the toner supply amount is controlled on the basis of the patch image for the toner supply in the image forming apparatus provided with no photosensitive member potential measuring sensor which is a high-function and expensive part, a degree of variation in toner density of the developer in the developing device 4 can be increased. In this case, a load exerted on the developer is increased, so that there is a possibility of occurrences of disadvantages such as an increase in abnormal image including a fog image or the like, and a decrease in lifetime of the developer.

For that reason, in order to eliminate the variation in laser irradiation portion potential on the photosensitive drum 2, the analog patch image (forming) method is employed. That is, the patch latent image for the toner supply is formed at a stable potential without being subjected to the laser exposure and then is developed to form the patch image. Incidentally, it is also possible to control the toner density by using the digital patch image (forming) method in a state in which the photosensitive member potential is sufficiently controlled. However, in this embodiment, a patch for correcting the charge potential described later may preferably be an analog patch and is usable in combination with the patch for controlling the toner density, thus being advantageous in terms of control time. Therefore, the analog patch image method is employed.

[Adjustment of Image Forming Condition on the Basis of Patch Density]

The control for adjusting the image forming condition on the basis of the optical density of the patch image, in place of the change in image forming condition by using a result of the measurement of the photosensitive member surface potential by the potential sensor, will be described in detail.

First, the charging property of the charging roller as the charging device in this embodiment and the lowering in charge potential of the photosensitive member due to the long term use will be described with reference to the drawings. Then, the reason why a potential corresponding to the developing contrast potential can be specified by the optical density will be described. Thereafter, how to adjust the image forming condition (the developing bias in this embodiment) by utilizing the optical density will be described along a flow chart. In this embodiment, an example in which the charging bias is adjusted on the basis of the patch image density will be described. It is also possible to employ a constitution for adjusting the example condition even when the developing bias is adjusted on the basis of the patch image density in order to prevent the image fog and the carrier deposition. That is, it is also possible to adjust, as the image forming condition other than the charging condition, conditions such as the developing condition, the example condition, and a combination of these conditions.

(Charging Property of Charging Roller and Durability Property of Photosensitive Member)

Figure 7:
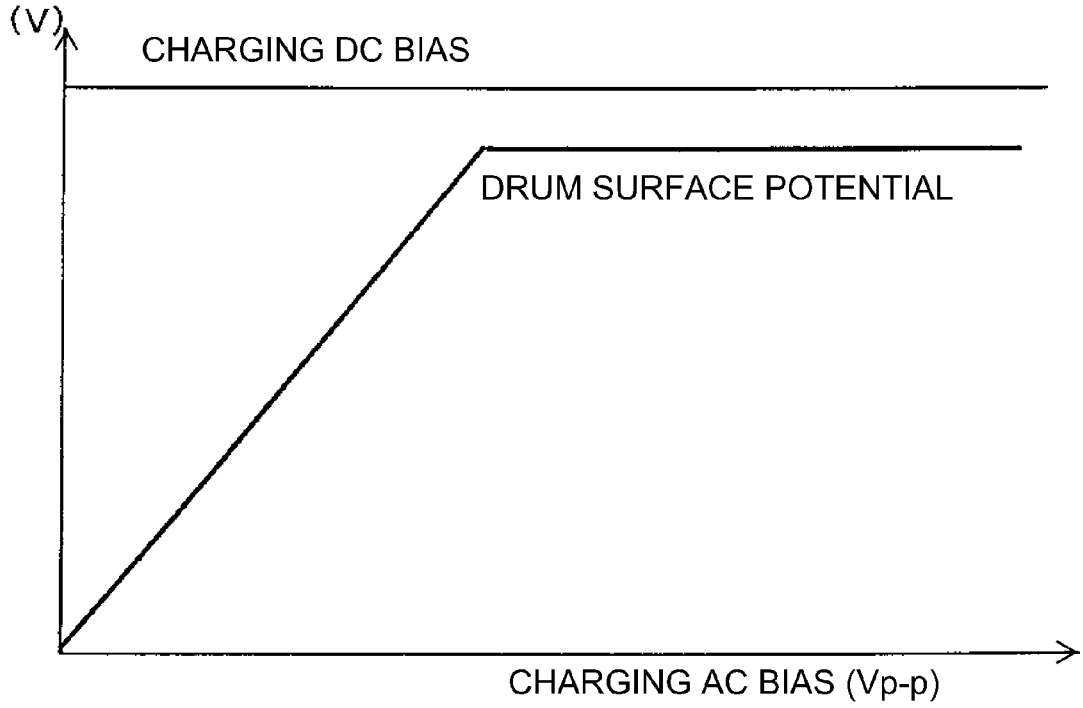
FIG. 7 is a graph for illustrating a charging property in a normal environment of a charging roller.

Correction of the charge potential will be described more specifically. In this embodiment, an electroconductive rubber roller is used as the charging member (hereinafter referred to as the "charging roller"). To this charging roller, a high voltage in the form of a DC bias, somewhat higher than a charge potential target value, superposed with an AC bias is applied from AC and DC high voltage sources. These high voltage sources are controlled by the CPU 61. FIG. 7 shows the charging property of the charging roller used in this embodiment in a normal environment (temperature: 20° C. and humidity: 30% RH). The image forming apparatus is provided with a pre-exposure device (not shown) including an LED (light emitting diode) of 660 nm in emission wavelength in order to prevent a ghost image of the latent image. As a result, the surface potential of the charged photosensitive member is attenuated by carriers (holes or electrons) generated by the pre-exposure, so that the resultant charge potential at the developing position is lower than the applied charging bias by about 50 V.

Figure 8:
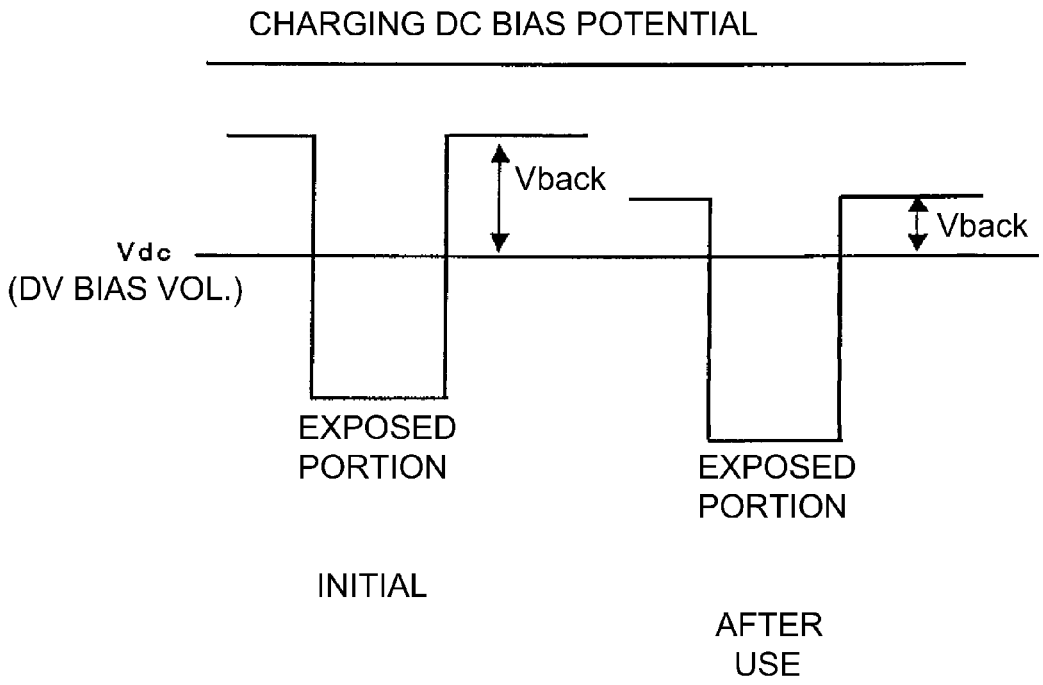
FIG. 8 is a schematic view showing a photosensitive member surface potential and a developing potential during image formation before and after long term use.

Next, the reason why the toner fog occurs will be described. FIG. 8 is a schematic view showing a relationship between the photosensitive member surface potential and the developing potential during the image formation before and after the long-term use. A resistance of the charging roller is increased by the long-term use and an amount of dark decay is increased due to photo-deterioration of the photosensitive member, so that the charge potential at the developing device position is lower than the value of the applied charging DC bias. Therefore, as shown in FIG. 8, a difference between the charge potential and the developing potential (hereinafter referred to as "Vback") is small. As a result, the toner is deposited on the photosensitive member at the non-image portion, so that the image defect which is called "fog" occurs.

(Calculating Procedure of Potential Lowering by Using 0 V Patch)

As described above, in order to suppress the occurrence of the image defect such as the fog, the photosensitive member is only required to be subjected to the measurement of the potential. However, in the case of using a small-size photosensitive drum in order to downsize the image forming apparatus, it is difficult to provide the potential sensor. Further, compared with the optical density sensor, the potential sensor for measuring the potential of the photosensitive member is expensive. For that reason, the procedure for measuring the amount of the lowering in charge potential by the long-term use of the photosensitive member by using the optical density sensor which is inexpensive compared with the potential sensor will be described.

The control device in this embodiment calculates the degree of the lowering in charge potential on the basis of the toner patch density and corrects the charging bias to be applied (high DC voltage condition) on the basis of a calculation result. Specifically, a plurality of patch images are formed, without subjecting the photosensitive drum 2 to the image exposure by the exposure means, at the photosensitive drum surface potential of 0 V and at one or more other potential. Then, these plural patch densities are detected by the image density sensor 17. On the basis of a result of this detection, the surface potential of the photosensitive drum 2 is calculated at the high charging DC voltage setting during the image formation and then the high DC voltage condition of the charging device 3 is corrected so as to provide a proper, i.e., predetermined image density during the image formation.

Figure 9:
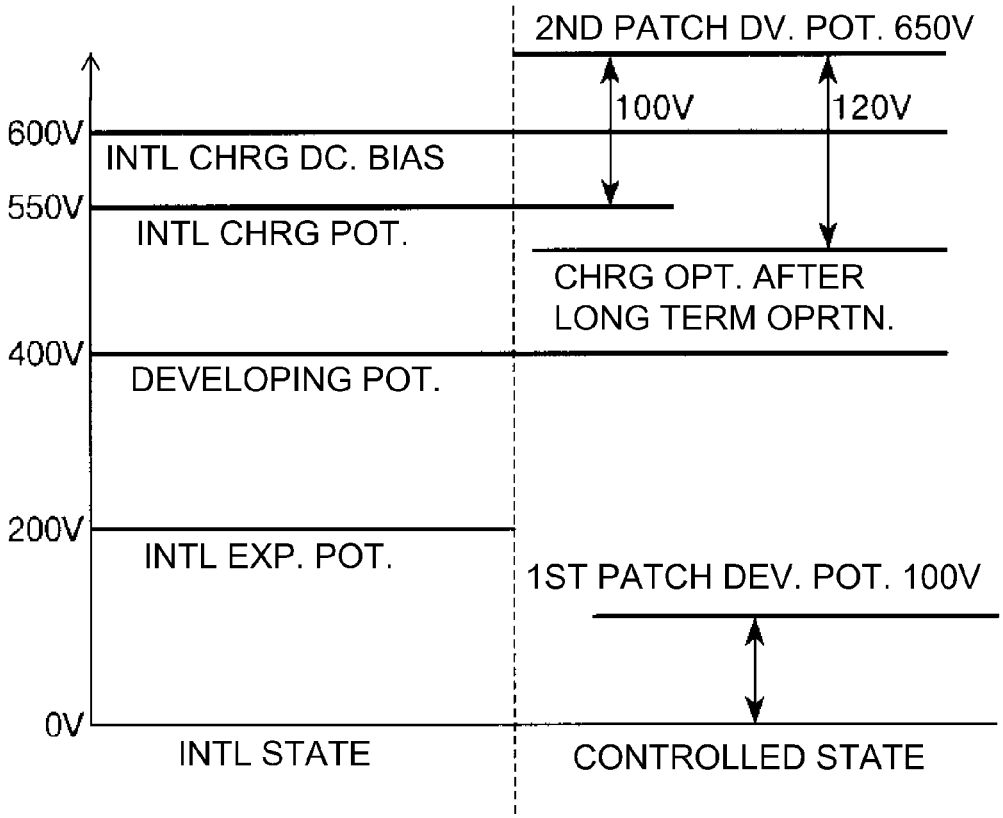
FIG. 9 is a schematic view for illustrating conditioned control.

FIG. 9 is a schematic view for illustrating specific contents of the control. In FIG. 9, on the left side, high voltage settings and potential states in an initial state of the long-term use are shown. In the initial state of the long-term use, the charging DC bias of 600 V is applied to the charging device and thereafter the charge potential of the photosensitive member which has been subjected to the pre-exposure is 550 V. Further, the developing DC bias applied to the developing device (hereinafter referred to as the developing potential) is 400 V, and the potential at the portion which has been subjected to exposure with a maximum exposure amount by using the exposure device is 200 V.

However, when the photosensitive member is used for the long term, the photosensitive member charge potential is lower than the target charge potential. The amount of this lowering in charge potential varies depending on the status of use and the environmental condition. For that reason, in the conventional image forming apparatus, the occurrence of the image defect was suppressed by determining the lowering amount of the charge potential by using the potential sensor and then by appropriately adjusting the image forming condition. On the other hand, in this embodiment, the lowering amount of the charge potential is calculated on the basis of the density of the patch of 0 V (zero volt).

First, by applying the charging DC bias of 0 V to the charging device, the potential of the photosensitive member surface is made 0 V. At the portion charged to 0 V, the developing DC bias (first developing bias) of 100 V is applied to the developing device. As a result, the 0 V patch (first patch) is formed. During the application of the charging DC bias is 0 V, the AC bias is superposed, so that the charge potential converges to substantially 0 V. For this reason, it is understood that the analog patch density at this time is the toner patch density when the electrostatic image corresponding to the developing contrast of 100 V. Incidentally, the photosensitive member surface is charged to 0 V, so that there is no lowering in charge potential due to the dark decay.

Then, the charging DC bias of 600 V is applied to the charging device. With the long-term use, when the charging DC bias of 600 V is applied to the charging device, the charge potential of the photosensitive member varies depending on the status of use. Here, the charge potential of the photosensitive member after the long-term use is assumed that it is 550 V similarly as in the case of the initial state of the long-term use. Then, the analog patch (second patch) is formed by applying to the developing device a second developing bias of 650 V higher than the first developing bias (100 V) so that the patch density corresponds to the developing contrast of 100 V similarly as in the case of the first patch. As described above, with the long-term use, the charge potential of the photosensitive member is lowered. As is understood from the high voltage settings and potential status shown on the right side of FIG. 9, when the photosensitive member charge potential after the long-term use is lowered to 620 V, the developing contrast of the second patch is 120 V, so that the second patch density is higher than the first patch density. Based on such a phenomenon, it is possible to calculate the photosensitive member charge potential after the long-term use.

Specifically, the first patch has the density corresponding to the developing contrast of 100 V, irrespective of the state of the long-term use. The second patch is formed with the charging DC bias of 600 V and with the developing DC bias of 650 V. In the case where the photosensitive member charge potential is 550 V similarly as in the initial state, the second patch density corresponds to the developing contrast of 100 V similarly as in the case of the first patch density. In the case where the photosensitive member charge potential is 550 V similarly as in the initial state of the long-term use, the second patch density corresponds to the developing contrast of 100 V similarly as in the case of the first patch density.

However, in the case where the photosensitive member charge potential is lowered by the long-term use, the resultant developing contrast is larger than 100 V. For that reason, the second patch density is higher than the first patch density. In other words, based on the degree of the increase in density of the second patch relative to the patch corresponding to the developing contrast of 100 V (i.e., the first patch), it is possible to estimate the degree of the lowering in photosensitive member charge potential by the long-term use. In the case where the first patch density and the second patch density are equal to each other, the degree of the lowering in photosensitive member charge potential by the long-term use is judged that there is no lowering. Therefore, there is no need to correct the high charging DC voltage which is the image forming condition.

As a method of correcting the charging DC bias to be applied to the charging device, various method can be considered depending on required accuracy of the charge potential. In this embodiment, the method of correcting Vback (the difference between the charge potential and the developing potential) depending on a ratio of change of the second patch density to the patch density corresponding to the developing contrast of 100 V (the first patch density) was employed.

For example, the first patch density (corresponding to the developing contrast of 100 V) is taken as 1.0. At this time, assuming that the density of the second patch (the applied charging DC bias: 600 V, the developing potential: 650 V) is 1.2, it is understood that the developing contrast when the second patch is formed is 120 V from the second patch density of 1.2 since the first patch density corresponding to the developing contrast of 100 V is 1.0. As a result, the photosensitive member charge potential Vd2 when the second patch is formed is judged that it is lowered to 530 V. That is, when the first patch developing potential is Vdc1, the second patch developing potential is Vdc2, the first patch detection density is D1 and the second patch detection density is D2, the developing contrast can be represented by the following equation:

$$Vd2=Vdc2-Vdc1\times D2/D1.$$

Therefore, in order to provide Vback (the difference between the charge potential and the developing potential) of 150 V similarly as in the case of the initial state of the long-term use, the charging DC bias is changed to 620 V by adding 20 V, corresponding to the lowering in charge potential Vd (550 V-530 V), to the initial charging DC bias. As a result, it is possible to compensate for the amount of the lowering photosensitive member charge potential by the long-term use to keep the photosensitive member charge potential at a level substantially equal to 550 V in the initial state of the long-term use. In the method in this embodiment, the change in developing property due to the use deterioration of the developer does not become a problem. This is because even in the case where the amount of developer, i.e., the image density is different at the same developing contrast, it is possible to make comparison between the first patch and the second patch at densities with respect to a certain developing contrast in the deterioration state.

Further strictly, the degree of the lowering in photosensitive member charge potential somewhat varies depending on the setting value of the applied charging DC bias. Specifically, in the case where the DC voltage of 800 V was applied to the charging roller by using the charging roller and the photosensitive member such that the photosensitive member charge potential was 550 V when the DC voltage of 600 V was applied to the charging roller, the photosensitive member charge potential was 735 V.

That is, there is a tendency that the electric field of the photosensitive member is intensified to increase the attenuation amount by increasing the high charging DC voltage setting value, thus resulting in a larger amount of the lowering in charge potential. Therefore, in the case where the DC voltage setting value to be corrected with the use is increased, a corresponding correction is made. Specifically, when 100 V correction is made with respect to the initial charging DC bias, the correction is only required to be made with 8 V extra. In the previous example, in the case where the charging bias is corrected by 20 V, the correction is actually made by 21.6 V (=20+(8/100)×20). For that reason, the bias to be applied to the charging roller in order to provide the photosensitive member charge potential of 550 V after the long-term use is changed to 621.6 V.

In this embodiment, every image output (image forming operation) on the predetermined number of sheets, e.g., 20 sheets, the first patch image is formed in the non-image area to control the toner supply amount as described above. Further, every completion of the image forming operation on the predetermined number of sheets, e.g., 1000 sheets, the second patch for correcting the charge potential is successively formed.

(Adjustment Control Along Flow Chart)

Figure 10:
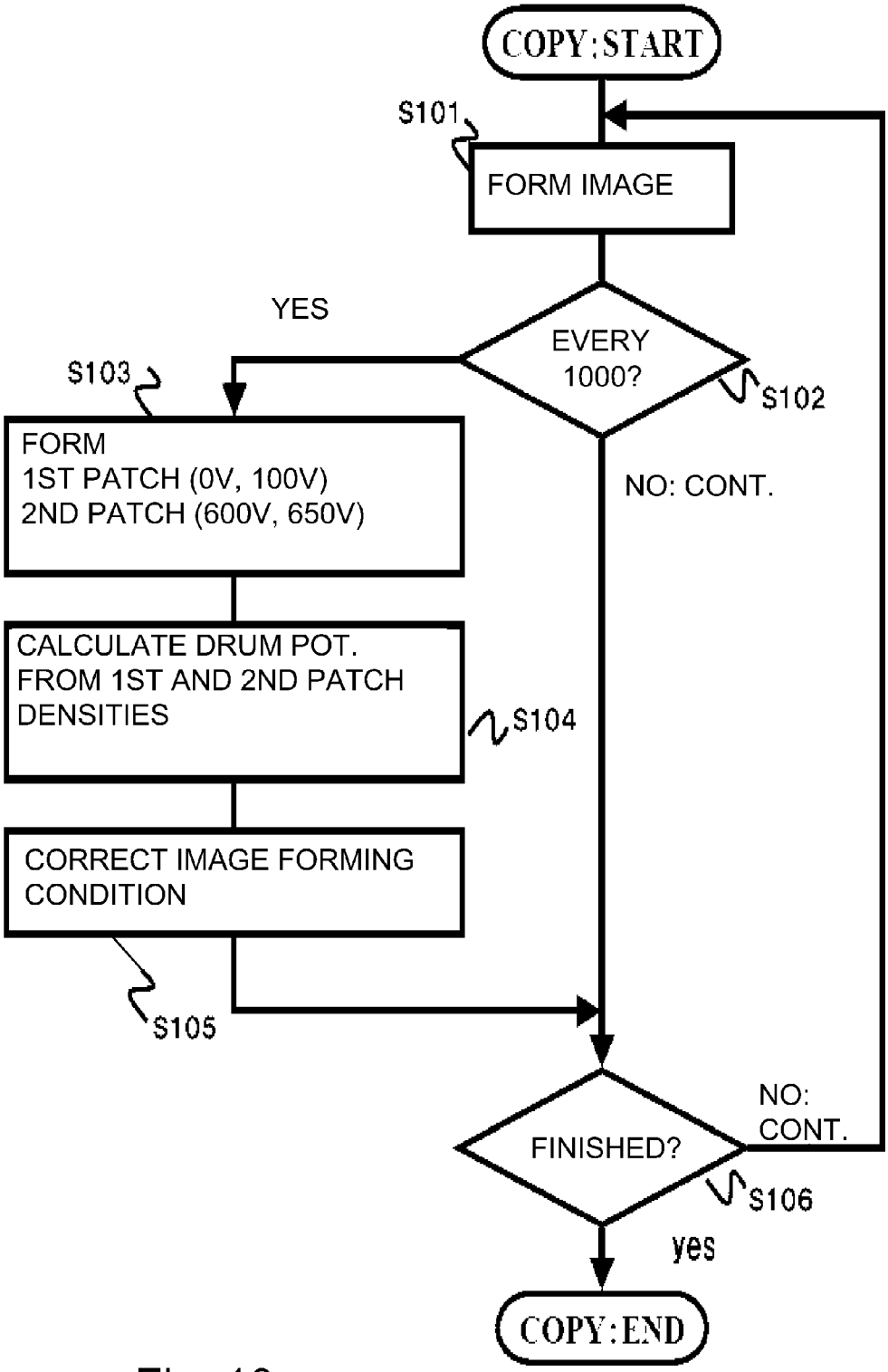
FIG. 10 is a flow chart for illustrating the conditioned control in Embodiment 1.

The control for calculating the degree of the lowering in photosensitive member charge potential by the long-term use on the basis of the first patch density and the second patch density as described above will be described along a flow chart. FIG. 10 is the flow chart showing a procedure of adjustment control for adjusting an image forming condition in this embodiment. The procedure for controlling the image forming portion by the CPU as the control means in accordance with a program will be described below.

The contents of the control by the CPU in respective steps will be explained in detail.

S101 is a step of forming an image based on an input image forming signal. The CPU as the control means forms the image on the recording material in accordance with the input image forming signal.

S102 is a step of executing an adjusting process for adjusting the charging bias every predetermined number of sheets. The CPU as the control means obtains the number of sheets subjected to image formation from a counter (not shown) for counting a total of the number of sheets subjected to image formation. Every 1000 sheets subjected to image formation, the adjusting process of S103 to S105 is performed. In the case where the number of sheets from the execution of the preceding adjusting process is less than 1000 sheets, the image formation is continued (S106).

S03 is a step of forming a toner patch for calculating an amount of lowering in photosensitive member charge potential by long-term use. The CPU as the control forms the first patch on the photosensitive member by applying the charging DC bias of 0 V to the charging device and by applying the developing DC bias of 100 V to the developing device. Similarly, the CPU forms the second patch on the photosensitive member by applying the charging DC bias of 600 V and by applying the developing DC bias of 650 V.

S104 is a step of calculating information, corresponding to the photosensitive member charge potential, from the formed first and second patches. The CPU as the control means calculates the photosensitive member charge potential from the above-described relationship between the developing contrast and the density on the basis of the first patch density and the second patch density which have been obtained from the density sensor.

S105 is a step of adjusting the image forming condition on the basis of the photosensitive member charge potential calculated in the step S104. The CPU as the control means controls (corrects) the value of the charging DC bias so that a proper developing contrast and proper Vback can be ensured, on the basis of the photosensitive member charge potential calculated in the step S104.

By the constitution as described above, in the image forming apparatus in a state in which it had output $140\times10^3$ sheets (after the long-term use), the charging DC bias was corrected by about 55 V. As a result, it was possible to maintain a good state without occurrences of the toner fog at the non-image portion and image defect due to the deposition of the carrier on the photosensitive member.

(Charge Portion of Photosensitive Member and Lowering in Potential by Long-Term Use)

Figure 11:
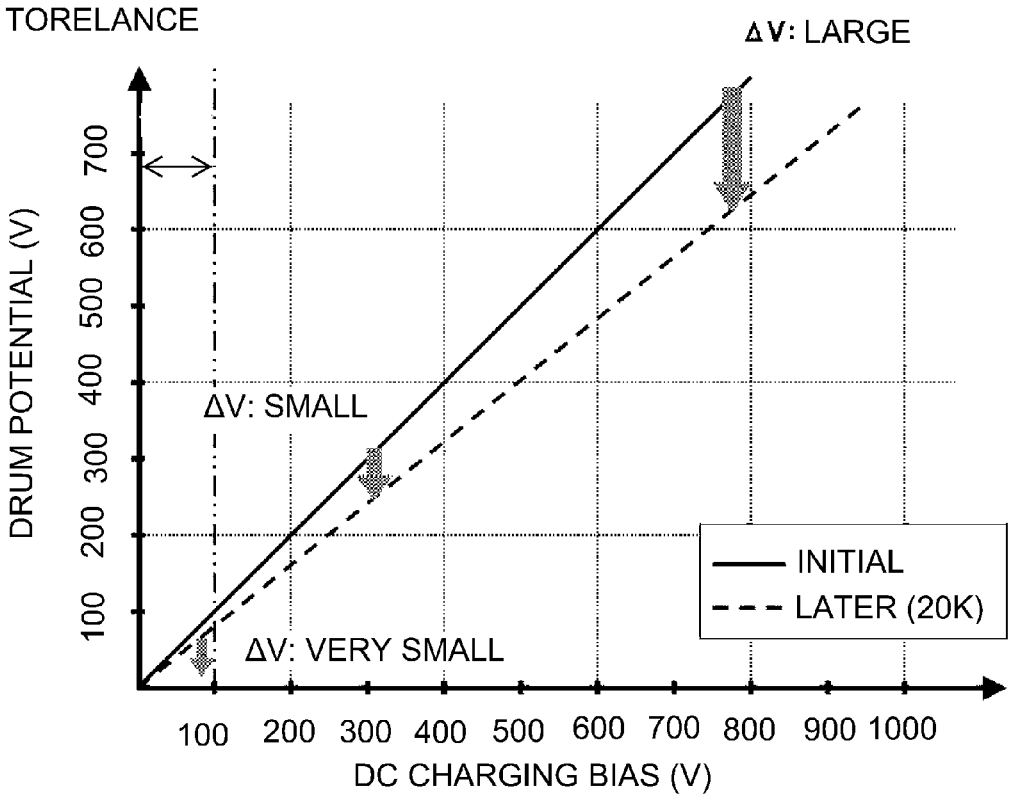
FIG. 11 is a graph showing a relationship between a charge potential of the photosensitive member and a DC charging bias.

The long-term use and the potential lowering will be described with reference to a graph. FIG. 11 is the graph showing a relationship between the charging DC bias and the charge potential of the photosensitive member. The abscissa represents the charging DC bias and the ordinate represents the charge potential of the photosensitive member. From this graph, at the initial stage of the long-term use (solid line), the value of the charging DC bias applied to the charging device substantially coincides with the value of the charge potential of the photosensitive member. However, at the latter stage of the long-term use (broken line) in which the image formation is carried out on $20\times10^3$ sheets, a deviation of the photosensitive member charge potential from the charging DC bias applied to the charging device (about 120 V under application of the charging DC bias of 700 V) occurs. It is difficult to estimate this lowering in charge potential due to a difference among individual devices.

In this embodiment, the charging DC bias of 0 V was applied to the charging roller. In the case where the bias of 0 V is applied to the charging roller, the photosensitive member charge potential is 0 V at not only the initial stage of the long-term use but also the latter stage of the long-term use. For that reason, it is possible to accurately determine the developing contrast with no influence of the lowering in charge potential by the long-term use.

In order to accurately determine the developing contrast before and after the long-term use, the amount of the lowering in photosensitive member charge potential by the long-term use may only be required to be small. Specifically, the lowering amount of the charge potential in the case where the charging DC bias of 100 V is applied is very small, i.e., about 10 V to about 20 V. For that reason, when the charging DC bias of 0 V is applied, the lowering amount of the charge potential is very small, so that the developing contrast potential can be determined with accuracy such that the occurrences of the fog and the carrier deposition can be sufficiently suppressed. In a preferred example, when the charging DC bias of approximately 0 V (0 V to 50 V) is applied, the lowering amount of the charge potential is substantially negligible. In the case where the charging device is charged to approximately 0 V (substantially 0 V), the developing contrast is changed. For this reason, a relationship between the density and the developing contrast as a reference is appropriately corrected by calculation.

Embodiment 2

Portions identical to those in Embodiment 1 are represented by the same reference numerals or symbols, thus being omitted from description. In this embodiment, in addition to the first patch and the second patch, by forming a third patch, the image forming condition is corrected more accurately.

In this embodiment, the first patch is formed at the charging DC bias of 0 V and the developing DC bias of 100 V, and the second patch is formed at the charging DC bias of 600 V and the developing DC bias of 650 V. Further, in the case where the second patch density is increased relative to the first patch density, the third patch is formed at the charging DC bias of 0 V and the developing DC bias of a value larger than 100 V.

In Embodiment 1, the first patch is formed at the charging DC bias of 0 V and the developing DC bias of 100 V (i.e., with the developing contrast of 100 V), so that the first patch density P1 is 1.0. Further, in the case where the second patch density P2 is 1.2 when the second patch is formed at the charging DC bias of 600 V and the developing DC bias of 650 V, the developing contrast is judged that it is 120 V. In other words, the charging potential Vd2 during the second patch formation was judged that it was lowered to 530 V.

Figure 13:
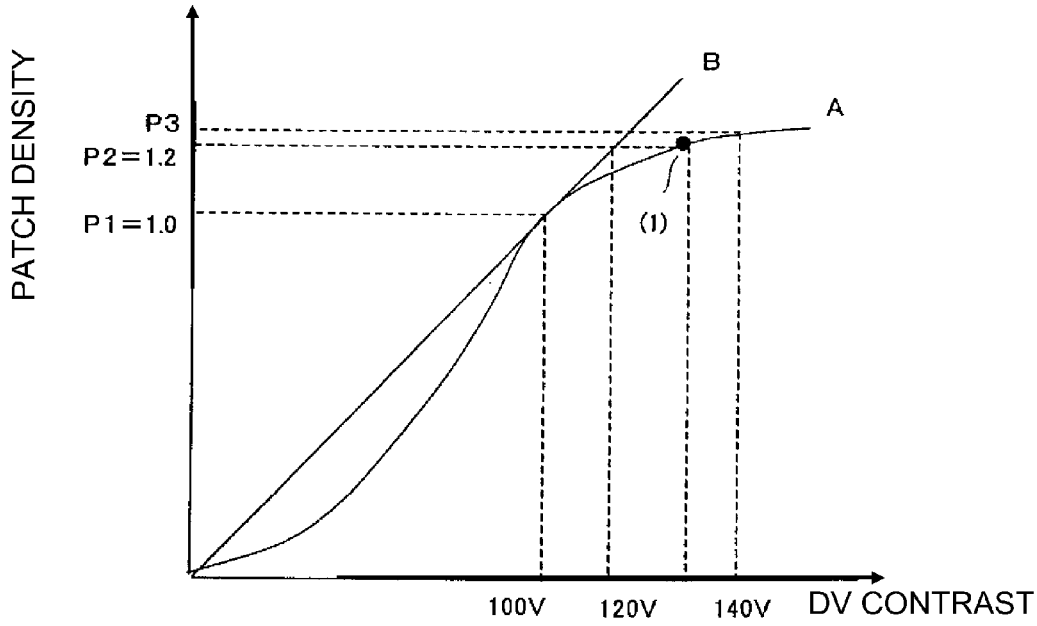
FIG. 13 is a graph for illustrating a relationship between a patch density and a developing contrast in Embodiment 2.

However, the relationship between the developing contrast and the patch density is not always a proportional relationship. FIG. 13 is a graph for illustrating the relationship between the patch density and the developing contrast. In FIG. 13, the ordinate represents the patch density and the abscissa represents the developing contrast. Here, it is assumed that the developing property of the image forming apparatus is represented by a curve A in the figure during the adjustment control.

According to the method in Embodiment 1, a tentative correction value Y=20 V is calculated from the results of P1 and P2 on the basis of a rectilinear line B. However, the second patch density is actually output at a point of position (1), so that the correction amount causes deviation. Therefore, in Embodiment 1, the lowering amount of 20 V (550 V-530 V) for the charging potential Vd was added to the charging DC bias and then the control was completed at the charging DC bias of 620 V.

In this embodiment, in consideration of the developing property, the image forming condition is corrected in the following manner.

Figure 12:
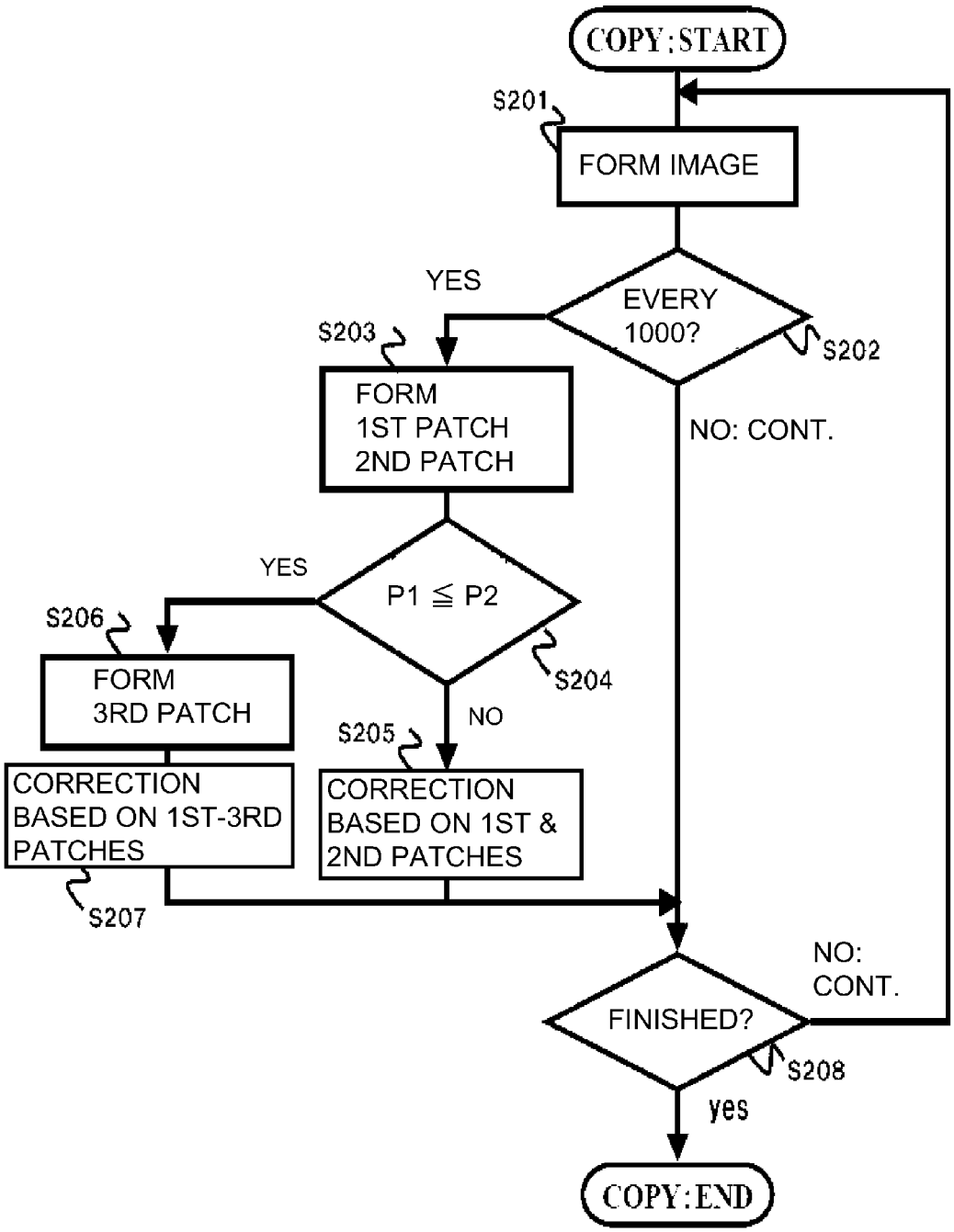
FIG. 12 is a flow chart for illustrating the conditioned control in Embodiment 2.

FIG. 12 is a flow chart for illustrating the adjustment control in this embodiment. In this embodiment, steps S201 to S203 and S208 are identical to the steps S101 to S103 and S106 in Embodiment 1, respectively, thus being omitted from description.

S204 is a step of changing the process on the basis of the first patch density and the second patch density. The CPU as the control means executes the process of S206 in the case where the second patch density (P2) is not less than the first patch density (P1). Further, the CPU executes the process of S205 in the case where the second patch density is less than the first patch density.

S205 is a step to be performed in the case where the second patch density is less than the first patch density. The image forming apparatus is liable to lower the photosensitive member charge potential by the long-term use. However, in the case where the second patch density is less than the first patch density. The charge potential of the photosensitive member is increased. Also in this case, the CPU as the control means adjusts the image forming condition on the basis of the first patch density and the second patch density by the method described in Embodiment 1.

S206 is a step to be performed in the case where the second patch density is not less than the first patch density. The CPU calculates the correction amount (20 V) from the difference between the first patch density and the second patch density. Then, with the developing contrast larger than the developing contrast (100 V) for the first patch by two times (40 V) the calculated correction amount (20 V), the third patch is formed (with the developing contrast of 140 V). Specifically, the third patch is formed by applying the charging DC bias of 0 V to the charging device and by applying the developing DC bias of 140 V to the developing device.

Then, the CPU as the control means accurately calculates the developing contrast, when the second patch is formed, on the basis of the first patch density, the third patch density and the second patch density. Specifically, when the third patch density is P3, the developing contrast can be obtained with accuracy in a step S207 according to the following formula:

$$(P2-P1)/(P3-P1)+Vdc1.$$

When P3 is 1.25, the developing contrast for the second patch is 132 V. Therefore, the applied charging DC bias value during the image formation is set at 632 V by adding 32 V to the charging DC bias (600 V), so that Vback of 150 V is ensured.

As described above, according to the present invention, the analog patch is formed at the photosensitive member charge potential of 0 V and then the density is measured, so that it is possible to suppress the occurrences of the toner fog at the non-image portion and the image defect due to the carrier deposition on the photosensitive member.

When the analog patch is formed at the photosensitive member charge potential of 0 V in order to form the first patch, the photosensitive member which has the surface potential sufficiently converging to 0 V potential by the pre-exposure does not require the charging bias application. Further, when the charge potential with respect to the applied charging bias is approximately 0 V and is at a level which can be sufficiently determined, the charge potential is usable. Further, the number of the patches and the high voltage settings are not restrictive but can be changed to any values depending on required accuracy, the operation environment and the developing property. Further, the developing contrast can be corrected by performing the correction of the exposure means at the same time. The charging method is also not limited to the charging roller method but may also similarly employ corona charging, brush charging, and the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 140604/2009 filed Jun. 11, 2009, which is hereby incorporated by reference.

What is claimed is:

1. An image forming apparatus comprising:

a photosensitive member;

charging means for electrically charging said photosensitive member;

exposure means for exposing to light said photosensitive member electrically charged by said charging means to form an electrostatic image;

developing means for developing the electrostatic image with toner to form a first patch and a second patch;

detecting means for detecting a density of the first and second patches formed by said developing means; and control means for controlling an image forming condition on the basis of a difference in density between the first patch formed on said photosensitive member at a portion where a surface potential of said photosensitive member is zero volts and the second patch formed on said photosensitive member at a portion electrically charged by applying a predetermined charging bias to said charging means, wherein said control means controls the image forming condition on the basis of the difference in density between the first patch and the second patch formed with substantially no emission of light from said exposure means, and controls density gradation during image formation on the basis of a density of a patch formed by effecting imagewise exposure by said exposure means.

2. An apparatus according to claim 1, wherein said charging means is a charging roller for electrically charging said photosensitive member while in contact with said photosensitive member, and wherein a DC bias of zero volts is applied to said charging roller for forming the first patch.

3. An image forming apparatus comprising:

a photosensitive member;

charging means for electrically charging said photosensitive member;

exposure means for exposing to light said photosensitive member electrically charged by said charging means to form an electrostatic image;

developing means for developing the electrostatic image with toner to form a first patch and a second patch;

detecting means for detecting a density of the first and second patches formed by said developing means; and control means for controlling an image forming condition on the basis of a difference in density between the first patch formed by applying a DC voltage of substantially zero volts to said charging means and applying a first bias to said developing means and the second patch formed by applying a predetermined DC voltage to said charging means and applying a second bias to said developing means, wherein said control means controls the image forming condition on the basis of the difference in density between the first patch and the second patch formed with substantially no emission of light from said exposure means, and controls density gradation during image formation on the basis of a density of a patch formed by effecting imagewise exposure by said exposure means.

4. An apparatus according to claim 3, wherein the second bias is larger than the first bias.

* * * * *